US011445314B2

(12) United States Patent
Satoh et al.

(10) Patent No.: US 11,445,314 B2
(45) Date of Patent: Sep. 13, 2022

(54) CONTROL APPARATUS, COMPUTER READABLE MEDIUM AND MICROPHONE SYSTEM

(71) Applicant: Audio-Technica Corporation, Tokyo (JP)

(72) Inventors: Hiroki Satoh, Tokyo (JP); Alexander Lepges, Lohmar (DE)

(73) Assignee: AUDIO-TECHNICA CORPORATION, Tokyo (JP)

( * ) Notice: Subject to any disclaimer, the term of this patent is extended or adjusted under 35 U.S.C. 154(b) by 56 days.

(21) Appl. No.: 16/922,298

(22) Filed: Jul. 7, 2020

(65) Prior Publication Data

US 2021/0014622 A1 Jan. 14, 2021

(30) Foreign Application Priority Data

Jul. 8, 2019 (JP) ..... JP2019-127202

(51) Int. Cl.

| | |
|---|---|
| ***H04R 27/00*** | (2006.01) |
| ***G10L 25/60*** | (2013.01) |
| ***H04R 1/40*** | (2006.01) |
| ***H04R 3/12*** | (2006.01) |
| ***H04R 29/00*** | (2006.01) |

(52) U.S. Cl.

CPC ..... *H04R 27/00* (2013.01); *G10L 25/60* (2013.01); *H04R 1/403* (2013.01); *H04R 3/12* (2013.01); *H04R 29/002* (2013.01); *H04R 2227/001* (2013.01); *H04R 2420/07* (2013.01)

(58) Field of Classification Search

CPC ..... H04R 27/00; H04R 1/403; H04R 3/12; H04R 29/002; H04R 2227/001; H04R 2420/07; H04R 2227/009

USPC ..... 381/77, 79–82, 85, 122

See application file for complete search history.

(56) References Cited

U.S. PATENT DOCUMENTS

| | | | | |
|---|---|---|---|---|
| 5,179,719 | A * | 1/1993 | Hidaka | H04H 20/89 455/3.03 |
| 9,621,224 | B2 * | 4/2017 | Babarskas | H04B 3/542 |
| 10,433,084 | B2 * | 10/2019 | Anderson | G10L 19/005 |
| 2008/0037802 | A1 * | 2/2008 | Posa | H04M 1/6033 348/E7.079 |
| 2012/0258751 | A1 | 10/2012 | Koch | |

(Continued)

FOREIGN PATENT DOCUMENTS

| | | | |
|---|---|---|---|
| EP | 1 161 108 | A1 | 12/2001 |
| JP | 2006-054601 | A | 2/2006 |

OTHER PUBLICATIONS

European Search Report, EP2018184047, dated Dec. 4, 2020.
Partial European Search Report, dated Aug. 28, 2020.

*Primary Examiner* — Disler Paul
(74) *Attorney, Agent, or Firm* — WCF IP

(57) ABSTRACT

A control device is a control device for controlling a plurality of receiver devices for receiving a sound signal transmitted from a wireless microphone by radio, the control device includes an information acquisition part that acquires quality information indicating a quality of the sound signal received by the plurality of receiver devices, and a determination part that determines, on the basis of the quality of the sound signal indicated by the quality information, a non-output receiver device that does not cause a speaker to output the sound based on the sound signal out of the plurality of receiver devices.

16 Claims, 8 Drawing Sheets

(56) References Cited

U.S. PATENT DOCUMENTS

| | | | | |
|---|---|---|---|---|
| 2019/0166423 | A1 | 5/2019 | Anderson | |
| 2021/0160604 | A1* | 5/2021 | Van Gheem ..... | H04R 3/00 |

* cited by examiner

CONTROL APPARATUS, COMPUTER READABLE MEDIUM AND MICROPHONE SYSTEM

CROSS-REFERENCE TO RELATED APPLICATIONS

The present application claims priority to Japanese Patent Applications number 2019-127202, filed on Jul. 8, 2019. The contents of this application are incorporated herein by reference in their entirety.

BACKGROUND OF THE INVENTION

The present invention relates to a control device, a computer readable medium, and a microphone system for controlling a receiver device that outputs a sound transmitted from a wireless microphone.

Conventionally, a public address (PA) system, which assigns a plurality of communication channels having different frequencies to a plurality of wireless microphones and to a plurality of receiver devices that receive radio signals transmitted by the plurality of wireless microphones, is known (see, Japanese Unexamined Patent Application Publication No. 2006-054601).

A conventional system assigns different frequency channels for each combination of a wireless microphone and a receiver device such that the wireless microphone and the receiver device are associated with each other. Accordingly, the conventional system has had to re-assign the frequency channel of the wireless microphone or the receiver device when switching the receiver device that receives the radio signal transmitted by the wireless microphone and outputs a sound signal transmitted with the received radio signal.

BRIEF SUMMARY OF THE INVENTION

The present invention focuses on these points, and an object of the present invention is to switch the receiver device that outputs the sound signal with the radio signal transmitted by the wireless microphone without switching the frequency used for wireless communication between the wireless microphone and the receiver device.

A control device of the first aspect of the present invention is a control device for controlling a plurality of receiver devices that each receive a sound signal transmitted from a wireless microphone by radio, the control device includes an information acquisition part that acquires quality information indicating a quality of the sound signal received by the plurality of receiver devices, and a determination part that determines, on the basis of the quality of the sound signal indicated by the quality information, a non-output receiver device that does not cause a speaker to output the sound based on the sound signal out of the plurality of receiver devices.

A computer readable medium storing a program of the second aspect of the present invention non-temporarily stores a program that causes a computer for controlling a plurality of receiver devices that receives a sound signal transmitted from a wireless microphone by radio to function as an information acquisition part that acquires quality information indicating a quality of the sound signal received by the plurality of receiver devices; and a determination part that determines, on the basis of the quality of the sound signal indicated by the quality information, a non-output receiver device that does not cause a speaker to output the sound based on the sound signal out of the plurality of receiver devices.

A microphone system of the third aspect of the present invention includes a wireless microphone, a plurality of receiver devices that receives a sound signal transmitted by the wireless microphone by radio, and a control device that controls the plurality of receiver devices, and the control device includes an information acquisition part that acquires quality information indicating a quality of the sound signal received by the plurality of receiver devices, and a determination part that determines, on the basis of the quality of the sound signal indicated by the quality information, a non-output receiver device that does not cause a speaker to output the sound based on the sound signal out of the plurality of receiver devices.

DETAILED DESCRIPTION OF THE INVENTION

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

The First Embodiment

[An Outline of a Microphone System S1]

Figure 1:
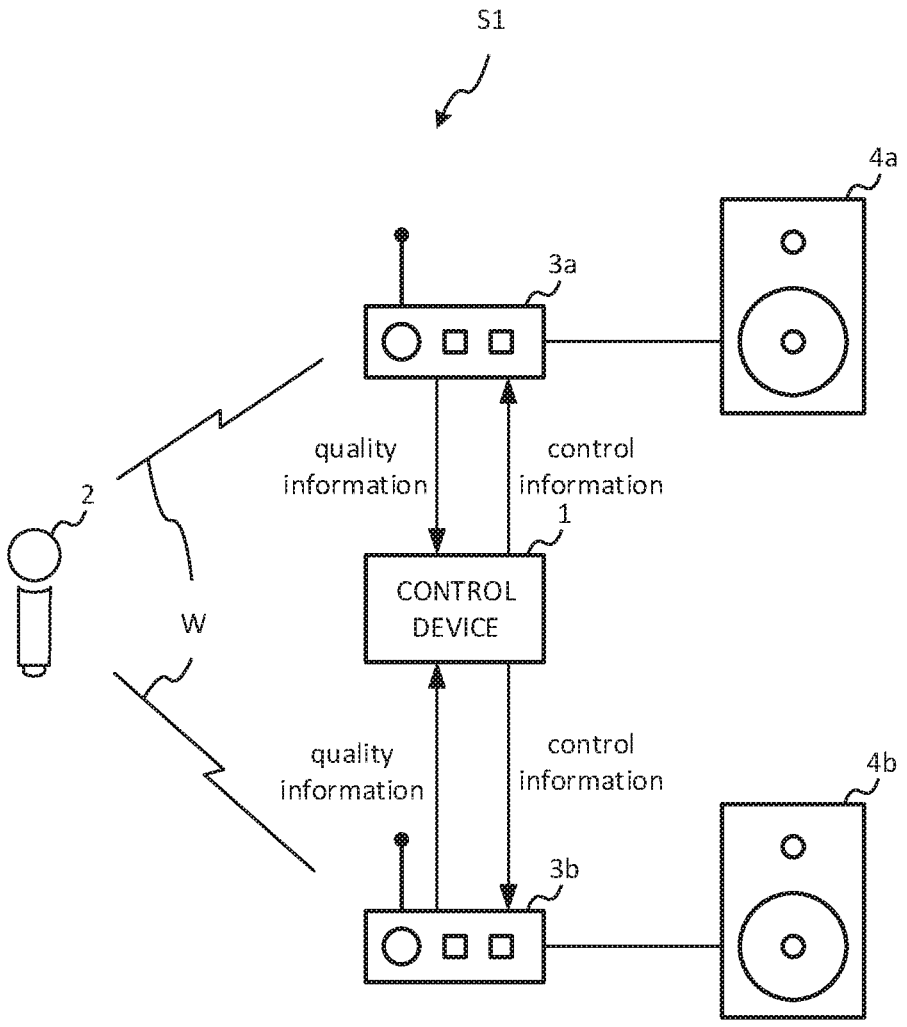
FIG. 1 is a diagram for explaining an outline of a microphone system according to the first embodiment.

FIG. 1 is a diagram for explaining an outline of a microphone system S1 according to the first embodiment. The microphone system S1 includes a control device 1, a wireless microphone 2, a receiver device 3*a*, a receiver device 3*b*, a speaker 4*a*, and a speaker 4*b*. The microphone system S1 is a system for outputting a sound, inputted to the wireless microphone 2, from the speaker 4*a* or the speaker 4*b* by controlling the receiver device 3*a* and the receiver device 3*b* with the control device 1. The microphone system S1 is, for example, a public address system.

The wireless microphone 2 converts the inputted sound into an electrical signal and transmits the electrical signal through a wireless channel W. The wireless channel W is a transmission path using radio waves. In the following explanation, the electrical signal generated by converting the sound by the wireless microphone 2 is referred to as a sound signal.

The receiver device 3*a* and the receiver device 3*b* receive the sound signal transmitted by the wireless microphone 2 through the wireless channel W. The receiver device 3*a* outputs the received sound signal to the speaker 4*a* connected to the receiver device 3*a*. The receiver device 3*b* outputs the received sound signal to the speaker 4*b* connected to the receiver device 3*b*. Hereinafter, when the receiver device 3*a* and the receiver device 3*b* do not need to be particularly distinguished from each other, they are referred to as a receiver device 3. The receiver device 3 has two modes: an output mode for causing the speaker 4 to output the sound based on the sound signal, and a mute mode for not causing the speaker 4 to output the sound based on the sound signal.

A plurality of receiver devices 3 transmits quality information indicating a quality of the sound signal received from the wireless microphone 2 to the control device 1. The quality information is, for example, information concerning a reception level, an SN ratio, a bit error rate, a volume, a sound quality, or the like.

The speaker 4*a* is connected to the receiver device 3*a*, and outputs the sound based on the sound signal outputted by the receiver device 3*a*. The speaker 4*b* is connected to the receiver device 3*b*, and outputs the sound based on the sound signal outputted by the receiver device 3*b*. Hereinafter, when the speaker 4*a* and the speaker 4*b* do not need to be particularly distinguished from each other, they are referred to as a speaker 4.

The control device 1 may be, for example, a personal computer or a server. The control device 1 is connected to each of the plurality of receiver devices 3 through a communication line (e.g., a LAN cable or a USB cable). The control device 1 acquires the quality information from each of the plurality of receiver devices 3. The control device 1 determines an output receiver device that causes the speaker 4 to output the sound based on the sound signal and a non-output receiver device that does not cause the speaker 4 to output the sound based on the sound signal, on the basis of the acquired quality information. For example, the control device 1 determines, out of the plurality of receiver devices 3, the receiver device 3 with a relatively low quality of the sound signal indicated by the quality information as the non-output receiver device. The control device 1 transmits control information to the non-output receiver device for setting the non-output device to the mute mode, which is a mode that does not cause a speaker 4 to output the sound based on the sound signal.

Figure 2:
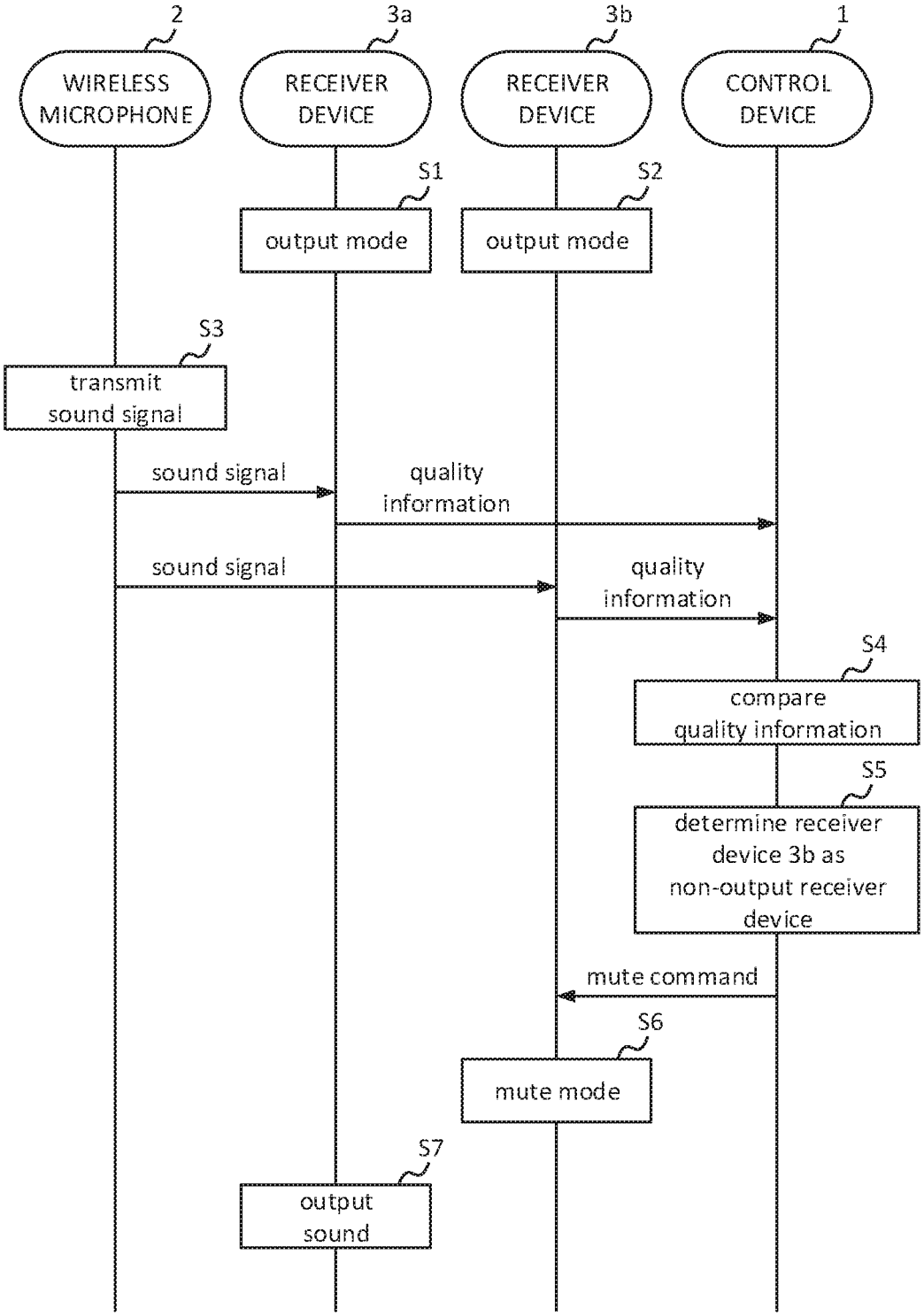
FIG. 2 is a sequence diagram showing a process immediately after the microphone system is activated.

FIG. 2 is a sequence diagram showing a process immediately after the microphone system is activated. When the microphone system S1 is activated, the receiver device 3*a* and the receiver device 3*b* are each set to the output mode for outputting the sound based on the sound signal received from the wireless microphone 2 (step S1 and step S2).

The wireless microphone 2 converts the inputted sound to the sound signal and transmits the converted sound signal into each of the plurality of receiver devices 3 through the wireless channel W (step S3). The receiver device 3*a* and receiver device 3*b* identify the quality of the sound signal received from the wireless microphone 2 and transmit the quality information indicating the identified quality to the control device 1.

The control device 1 compares the quality information transmitted by each of the receiver device 3*a* and the receiver device 3*b* (step S4). Here, it is assumed that the quality indicated by the quality information transmitted by the receiver device 3*b* is lower than the quality indicated by the quality information transmitted by the receiver device 3*a*. The control device 1 selects, on the basis of the quality information, a receiver device with a relatively low sound signal quality, i.e., the receiver device 3*b*, as the non-output receiver device out of the receiver device 3*a* and the receiver device 3*b* (step S5). The control device 1 transmits, to the receiver device 3*b*, the control information (hereinafter referred to as a mute command) for setting the receiver device 3*b* to the mute mode.

When receiving the mute command from the control device 1, the receiver device 3*b* sets the receiver device 3*b* to the mute mode (step S6), and does not output the sound signal received from the wireless microphone 2 to the speaker 4*b*. The receiver device 3*a* outputs the sound signal received from the wireless microphone 2 to the speaker 4*a* (step S7).

It should be noted that it is undesirable for the speaker 4*a* and the speaker 4*b* to output the sound during a period when the receiver device 3*a* or the receiver device 3*b* may receive the mute command after the receiver device 3*a* or the receiver device 3*b* has received the sound signal. Therefore, the receiver device 3*a* and the receiver device 3*b* may start outputting the sound signal on a condition that the mute command is not received until a predetermined period has passed after the quality information is transmitted to control device 1.

Figure 3:
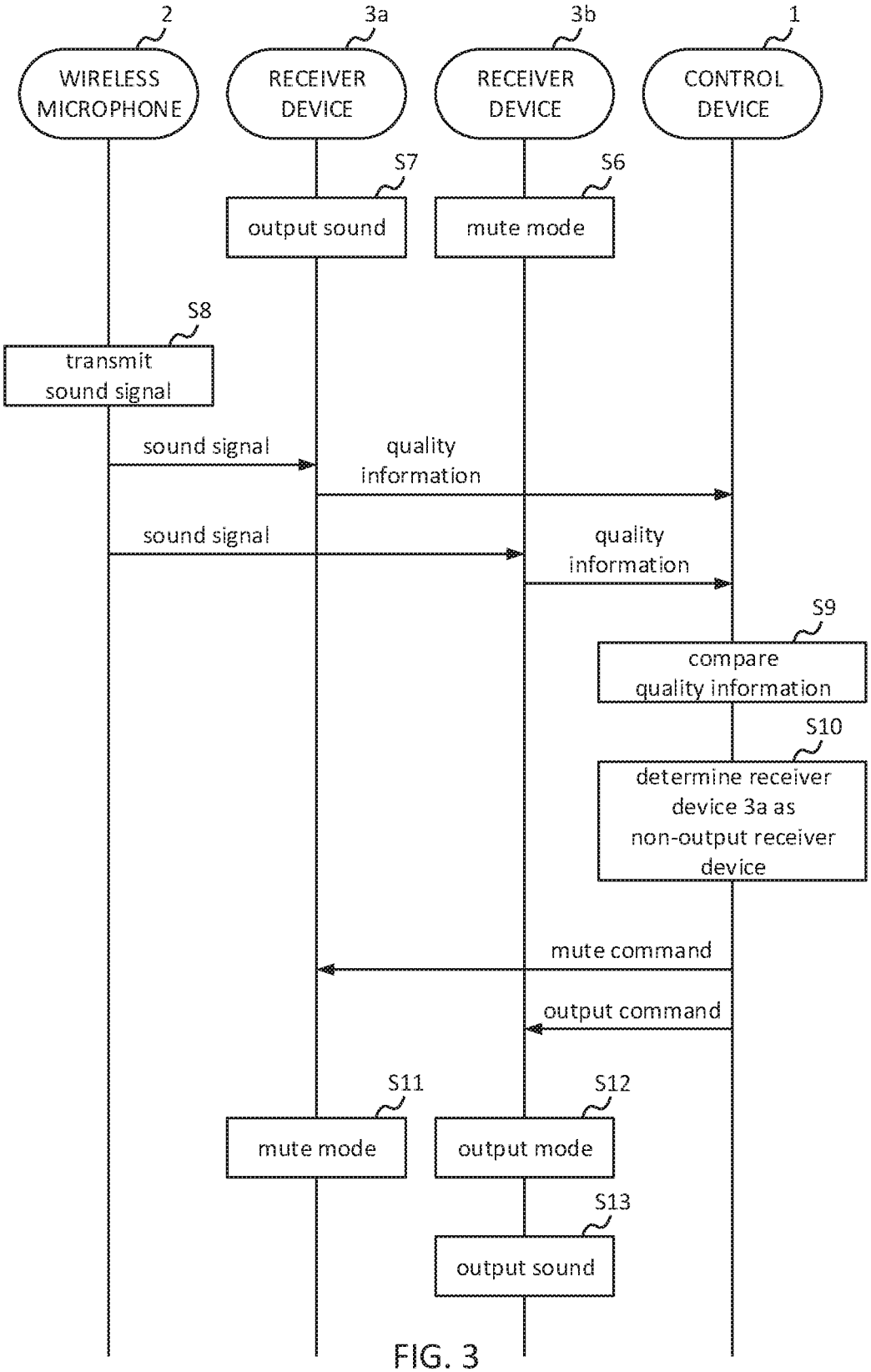
FIG. 3 is a sequence diagram showing a process when the microphone system switches a non-output receiver device.

FIG. 3 is a sequence diagram showing a process when the microphone system S1 switches the non-output receiver device. The sequence diagram of FIG. 3 shows a process subsequent to FIG. 2. Here, an above-described state where the receiver device 3*b* is selected as the non-output receiver device (step S6) and the receiver device 3*a* outputs the sound in the output mode (step S7) will be described as a state where the process of FIG. 3 starts.

The wireless microphone 2 converts the inputted sound into the sound signal and transmits the converted sound signal to each of the plurality of receiver devices 3 through the wireless channel W (step S8). At this time, it is assumed that the quality of the sound signal of the wireless microphone 2 has changed due to movement of the user. The receiver device 3*a* and receiver device 3*b* re-identify the quality of the sound signal received from the wireless microphone 2 and transmit the quality information indicating the identified quality to the control device 1.

The control device 1 compares the quality information transmitted by each of the receiver device 3*a* and the receiver device 3*b* (step S9). Here, it is assumed that the quality indicated by the quality information transmitted by the receiver device 3*a* has changed to be lower than the quality indicated by the quality information transmitted by the receiver device 3*b*, due to the movement of the wireless microphone 2. On the basis of the quality information, the control device 1 selects, out of the receiver device 3*a* and the receiver device 3*b*, a receiver device with a relatively low sound signal quality as the non-output receiver device that does not cause the speaker to output the sound based on the sound signal (step S10). That is, here, the control device 1 determines the receiver device 3*b* with a relatively high sound signal quality as the output receiver device.

The control device 1 then transmits the mute command to the receiver device 3*a* which is determined as the non-output receiver device. Further, the receiver device 3*a* that receives the mute command from the control device 1 switches to the mute mode (step S11) and does not output the sound signal, which is received from the wireless microphone 2, to the speaker 4*a*. When receiving the output command from the control device 1, the receiver device 3*b* switches to the output mode (step S12) and outputs the sound signal, received from the wireless microphone 2, to the speaker 4*b* (step S13). It should be noted that the control device 1 may transmit the output command to the receiver device 3*b* prior to transmitting the mute command to the receiver device 3*a*. Due to the control device 1 operating in this way, a state is maintained where at least one of the speaker 4*a* and the speaker 4*b* outputs the sound.

The microphone system S1 repeats the process shown in FIG. 3. Each time the control device 1 receives the quality information from the plurality of receiver devices 3, the control device 1 selects a receiver device on the basis of the received quality information and determines the non-output receiver device. In this way, the control device 1 changes, depending on the quality of the sound signal, the receiver device 3 that outputs the sound, inputted to the wireless microphone 2, to the speaker 4.

[A Functional Configuration of the Control Device 1]

Figure 4:
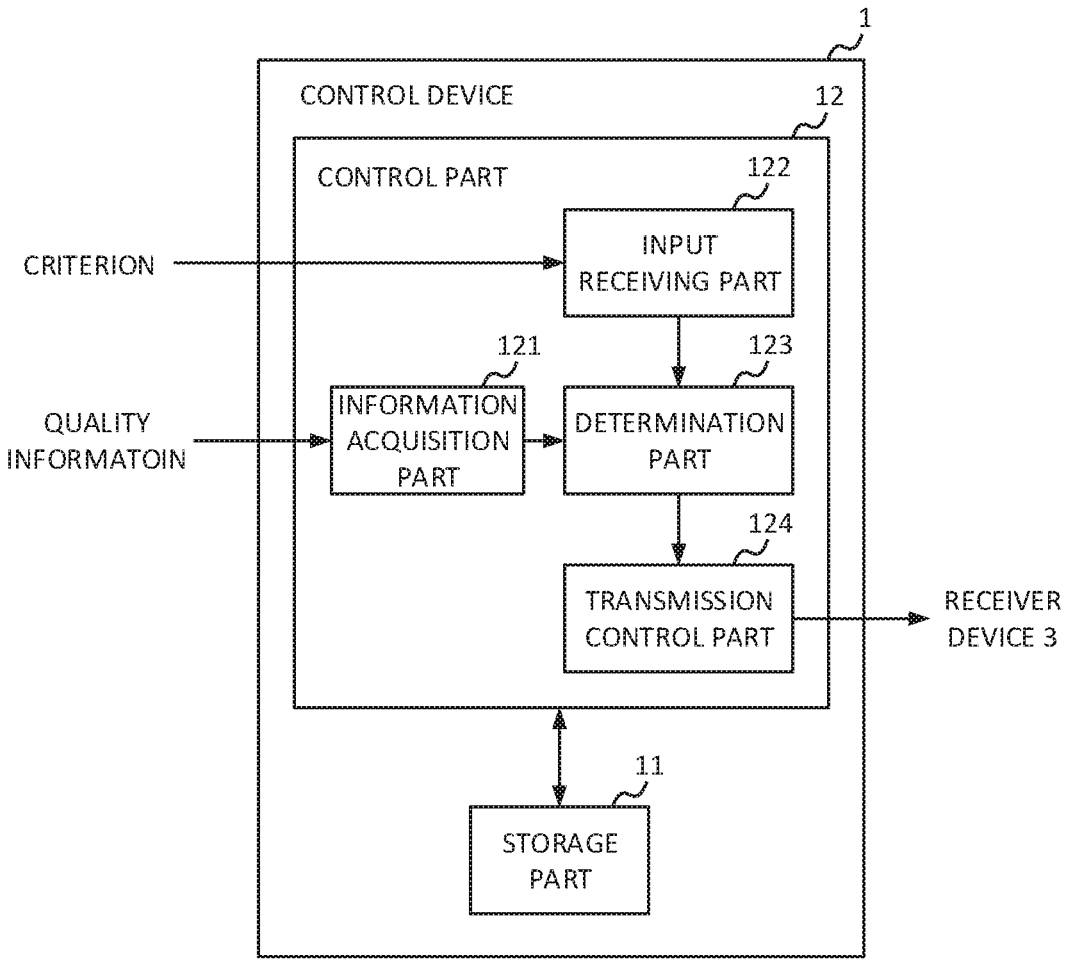
FIG. 4 shows a functional configuration of a control device.

FIG. 4 shows a functional configuration of the control device 1. The control device 1 includes a storage part 11 and a control part 12.

The storage part 11 includes a storage medium such as a Read Only Memory (ROM) or a Random Access Memory (RAM). The storage part 11 stores various programs for causing the control part 12 to function.

The control part 12 includes a processor such as a Central Processing Unit (CPU). The control part 12 functions as an information acquisition part 121, a determination part 123, a transmission control part 124, and an input receiving part 122 by executing the programs stored in the storage part 11.

The information acquisition part 121 acquires the quality information indicating the quality of the sound signal received by the plurality of receiver devices 3. The information acquisition part 121 notifies the determination part 123 of the acquired quality information.

The input receiving part 122 receives an input of criteria for the determination part 123 to determine the non-output receiver device. For example, the input receiving part 122 displays an input window for receiving an input of the criteria on a display connected to the control device 1. The input receiving part 122 notifies the determination part 123 about the criteria inputted to the input window. Details of the criteria will be described later.

On the basis of the quality of the sound signal indicated by the quality information, the determination part 123 determines, out of the plurality of receiver devices 3, the output receiver device that outputs the sound based on the sound signal to the speaker 4 and the non-output receiver device that does not output the sound based on the sound signal to the speaker 4. The determination part 123 determines, for example, the receiver device 3 having the highest sound signal quality as the output receiver device and all other receiver devices 3 as the non-output receiver devices. The determination part 123 determines, for example, the output receiver device and the non-output receiver device by comparing the criteria in the notification from the input receiving part 122 with the quality indicated by the quality information.

The transmission control part 124 transmits, to the receiver device 3 determined as the non-output receiver device, the control information (the mute command) for setting the receiver device 3 to the mute mode. The transmission control part 124 may transmit, to the receiver device 3, the control information (the output command) for switching to the output mode that causes the speaker 4 to output the sound based on the sound signal. The transmission control unit 124 transmits, for example, control information for switching to the output mode to the receiver device 3 that has been in the mute mode and causes the speaker 4 to output the sound based on the sound signal. Due to the transmission control part 124 operating in this way, the control device 1 can control one receiver device 3 to output the sound signal and all other receiver devices 3 to not output the sound signal, out of the plurality of receiver devices 3 connected to the control device 1.

The determination part 123 determines the non-output receiver device by comparing the criteria to the quality indicated by the quality information. The determination part 123 switches the receiver device 3 that outputs the sound signal on the basis of the determination. Hereinafter, a process in which the determination part 123 switches the output receiver device by comparing the criteria to the quality indicated by the quality information will be described.

[A Flowchart of the Process of Switching the Receiver Device 3]

Figure 5:
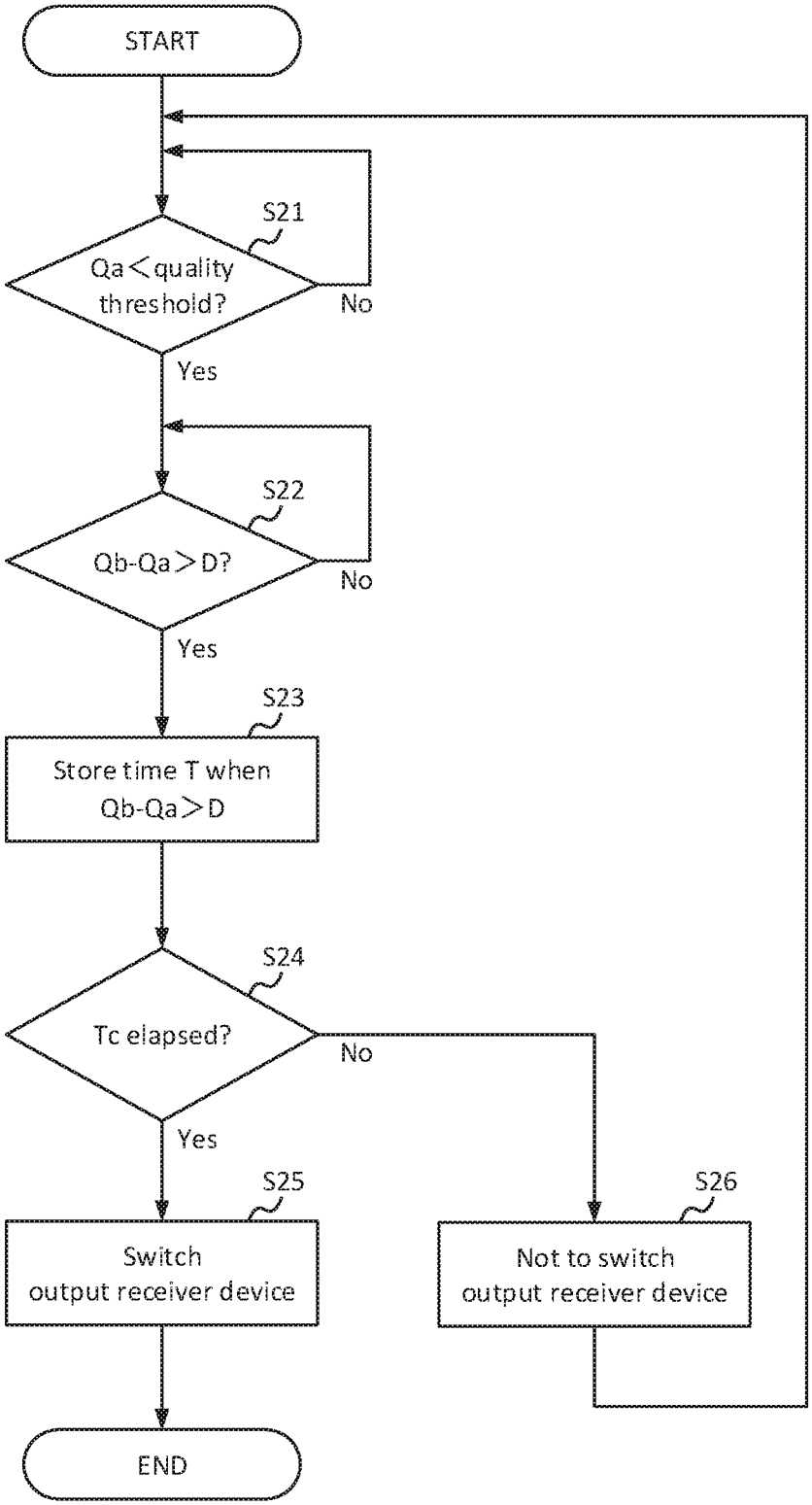
FIG. 5 is a flowchart showing a process of a determination part switching the receiver device that outputs a sound signal.

FIG. 5 is a flowchart showing a process of the determination part 123 switching the receiver device 3 that outputs the sound signal. The criteria used by the determination part 123 are, for example, a quality threshold Th, a difference threshold D, and a duration threshold Tc. FIG. 5 shows a state where the receiver device 3*a* outputs the sound signal as a starting state.

The determination par 123 determines whether a quality Qa is smaller than the quality threshold Th (step S21). The Quality Qa is a numerical value corresponding to the quality indicated by the quality information received from the receiver device 3*a* outputting the sound signal, and the higher the quality, the greater the quality Qa. If the quality information indicates a reception level, the quality Qa is, for example, a numerical value of the reception level. If the quality information indicates a bit error rate, the quality Qa is, for example, a reciprocal number of the bit error rate.

If the quality Qa is equal to or greater than the quality threshold Th (No in step S21), the determination part 123 waits until the quality Qa becomes smaller than the quality threshold Th. That is, the determination part 123 does not switch the receiver device 3 that outputs the sound signal. When the quality Qa is smaller than the quality threshold Th (Yes in step S21), the determination part 123 determines whether the difference between the quality Qb of the receiver device 3*b* not outputting the sound signal and the quality Qa is larger than the difference threshold D (step S22). Here, the quality Qb is the quality indicated by the quality information transmitted by the receiver device 3*b*, indicating the quality when the receiver device 3*b* is not outputting the sound signal.

If the difference between the quality Qb and the quality Qa is equal to or less than the difference threshold D (No in step S22), the determination part 123 does not switch the receiver device 3 that outputs the sound signal. If the difference between the quality Qb and the quality Qa is larger than the difference threshold D (Yes in step S22), the determination part 123 stores a time T at which the difference between the quality Qb and the quality Qa becomes larger than the difference threshold D (step S23). The determination part 123 then determines whether a time corresponding to the duration threshold Tc passes from the time T (step S24).

If a time corresponding to the duration threshold Tc passes from the time T (Yes in step S24), the determination part 123 switches the receiver device 3 that outputs the sound signal to another receiver device 3 (the receiver device 3*b* in the case of the example shown in FIG. 5) (step S25). The transmission control part 124 transmits the mute command to the receiver device 3*a* and transmits the output command to the receiver device 3*b*. If a time corresponding to the duration threshold Tc has not passed from the time T (No in step S24), the determination part 123 does not switch the receiver device 3 that outputs the sound signal (step S26), and returns the process to step S21.

The quality Q of the sound signal is monitored so that the determination part 123 appropriately switches the receiver device 3 that outputs the sound signal according to the change of the communication quality due to changes of positional relationships, distances, and the like between the wireless microphone 2 and each of the plurality of receiver devices 3. It is undesirable that the receiver device 3 is switched due to an instantaneous fluctuation of the quality of the sound signal from the wireless microphone 2. Therefore, the determination part 123 determines whether to switch the receiver device 3 that outputs the sound signal by using the difference threshold D and the duration threshold Tc. Due to the determination part 123 performing such an operation, the switching of the receiver device 3 due to the instantaneous fluctuation of the quality of the sound signal is suppressed, and the output state of the sound from the speaker 4 is stabilized.

Figure 6:
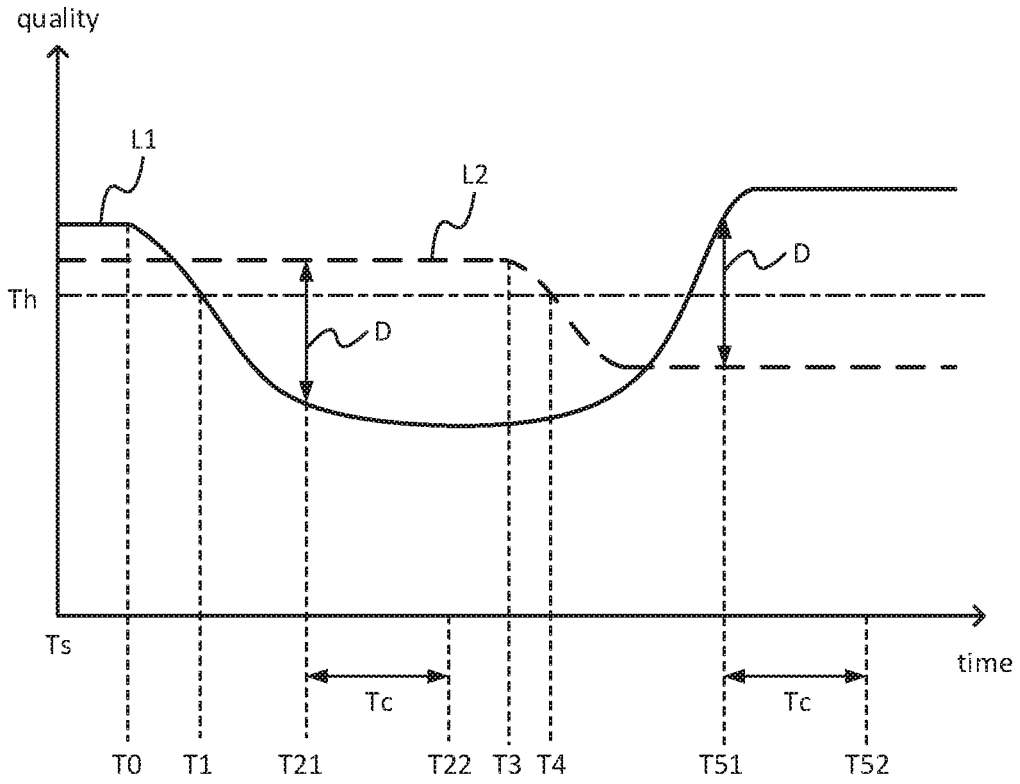
FIG. 6 shows a relationship between a quality indicated by quality information and the receiver device that outputs the sound signal.

FIG. 6 shows a relationship between the quality indicated by the quality information and the receiver device 3 that outputs the sound signal. In FIG. 6, the horizontal axis represents the time and the vertical axis represents the quality. A solid line L1 represents a variation of the quality Qa of the receiver device 3*a* over time. A broken line L2 represents a variation of the quality Qb of the receiver device 3*b* overtime. A dot-dash line represents the quality threshold Th. At a time Ts, it is assumed that the receiver device 3*a* is outputting the sound signal and the receiver device 3*b* is not outputting the sound signal.

In FIG. 6, the quality Qa starts to decrease from a time T0 and becomes smaller than the quality threshold Th at a time T1, and the difference between the quality Qa and the quality Qb becomes equal to or larger than the difference threshold D at a time T21. If a state where the difference between the quality Qa and the quality Qb is larger than the difference threshold D continues from the time T21 to a time T22, at which a time corresponding to the duration threshold Tc has passed from the time T21, the determination part 123 sets the receiver device 3*a* to the mute mode and sets the receiver device 3*b* to the output mode. That is, the determination part 123 switches the receiver device 3 that outputs the sound signal from the receiver device 3*a* to the receiver device 3*b*.

After the receiver device 3*a* is set to the mute mode and the receiver device 3*b* is set to the output mode, the determination part 123 monitors the quality Qb. Then, the quality Qb starts to decrease from a time T3, and the quality Qb becomes smaller than the quality threshold Th and the quality Qa increases at a time T4. At a time T52, at which a time corresponding to the duration threshold Tc passes from the time T51, at which the difference between the quality Qa and the quality Qb becomes larger than the difference threshold D, the determination part 123 further switches the receiver device 3 that outputs the sound signal from the receiver device 3*b* to the receiver device 3*a*.

[Determination of the Criteria on the Basis of a Usage Mode]

The determination part 123 may switch the receiver device 3 that outputs the sound signal using the criteria corresponding to a usage mode of the wireless microphone 2. In this case, for example, the input receiving part 122 receives an input of the usage mode of the wireless microphone 2. The usage mode is, for example, a usage mode in which the plurality of receiver devices 3 is installed on different floors of a building, or a usage mode in which the plurality of receiver devices 3 is installed in a wide area on a single floor such as an event venue.

The determination part 123 determines the non-output receiver device by comparing the quality indicated by the quality information with the criteria determined based on the usage mode. For example, in the usage mode in which the plurality of receiver devices 3 is installed on different floors of a building, the determination part 123 uses the criteria for not frequently causing the switching of the receiver device 3 that outputs the sound signal. In this case, the determination part 123 makes the difference threshold D larger or makes the duration threshold Tc longer than those for the case where the plurality of receiver devices 3 is installed on a single floor. Such operation of the determination part 123 suppresses the output of the sound signal by the receiver device 3 installed on the floor where a person stayed before, after the person using the wireless microphone 2 moves to another floor and the receiver device 3, which is installed on the floor to which the person has moved, starts outputting the sound signal.

In the usage mode where the plurality of receiver devices 3 is installed on a single floor of a building, the determination part 123 uses the criteria for which the receiver device 3 that outputs the sound signal is easier to be switched. In this case, the determination part 123 makes the difference threshold D smaller or makes the duration threshold Tc shorter than those for the case where the plurality of receiver devices 3 is installed on different floors.

That is, in a first usage mode, in which the switching of the receiver device 3 that outputs the sound signal does not occur very often, the determination part 123 makes a first difference threshold D larger than a second difference threshold D in a second usage mode. The first difference threshold D and the second difference threshold D are the differences between the qualities of the sound signals respectively received by the two receiver devices 3, required to switch the receiver device 3 that outputs the sound signal. Further, the determination part 123 may make a first duration threshold used for switching the receiver device 3 that outputs the sound signal in the first usage mode longer than a second duration threshold used for switching the receiver device 3 that outputs the sound signal in the second usage mode. The first duration threshold is a duration time required to switch the receiver device 3 that outputs the sound signal, in a state where the difference between the qualities of the sound signals respectively received by the two receiver devices 3 is greater than the first difference threshold. The second duration threshold is a duration time, required to switch the receiver device 3 that outputs the sound signal, in a state where the difference between the qualities of the sound signals respectively received by the two receiver devices 3 is greater than the second difference threshold. Due to the determination part 123 operating in this way, it is possible to switch the receiver device 3 quickly if the most suitable receiver device 3 for the output changes due to the change of the position of the person using the wireless microphone 2, and therefore the sound inputted to the wireless microphone 2 can be outputted from the speaker 4 with a higher quality.

[Inhibiting the Switching of the Receiver Device 3]

For example, if one receiver device 3 is installed in each of a plurality of floors and the person using the wireless microphone 2 does not move to another floor (that is, he/she stays on the same floor), it is not preferable to switch the non-output receiver device. Therefore, the wireless microphone 2 may include an operation part (e.g., a switch) for selecting whether to permit the switching of the non-output receiver device.

The wireless microphone 2 transmits permission/rejection information indicating whether to permit the switching of the non-output receiver device to the receiver device 3 on the basis of a state of the operation part. Specifically, for example, if the state of the operation part changes, the wireless microphone 2 transmits the permission/rejection information corresponding to the change of the operation part to the receiver device 3. Upon receiving the permission/rejection information from the wireless microphone 2, the receiver device 3 transmits the permission/rejection information to the control device 1.

The information acquisition part 121 acquires the permission/rejection information from the receiver device 3, and notifies the determination part 123 about the acquired permission/rejection information. On the basis of the permission/rejection information acquired by the information acquisition part 121, the determination part 123 determines whether to switch the non-output receiver device on the basis of the quality information. Specifically, the determination part 123 determines the non-output receiver device on the basis of the quality of the sound signal if the permission/rejection information indicates that the switching of the non-output receiver device is allowed. The determination part 123 does not determine the non-output receiver device on the basis of the quality of the sound signal if the permission/rejection information does not indicate that the switching of the non-output receiver device is allowed.

Due to the control device 1 operating in this way, the receiver device 3 that outputs the sound signal is not switched if the person using the wireless microphone 2 does not want to switch the receiver device 3 that outputs the sound signal.

[Effects of the Control Device 1 According to the First Embodiment]

As described above, the control device 1 determines, on the basis of the quality of the sound signal indicated by the quality information acquired from the plurality of receiver devices 3, the non-output receiver device that does not cause the speaker 4 to output the sound from the plurality of receiver devices 3. Due to the control device 1 operating in this manner, the microphone system S1 can switch the receiver device 3 that outputs the sound signal so as to output the sound based on the relatively high-quality sound signal without switching the frequency used for wireless communication between the wireless microphone 2 and the receiver device 3. It should be noted that, in the above description, a case where the receiver device 3*a* outputs the sound signal to the speaker 4*a* and the receiver device 3*b* outputs the sound signal to the speaker 4*b* is exemplified, but the receiver device 3*a* and the receiver device 3*b* may be connected to one speaker 4*a* and the receiver device 3 serving as the output receiver device out of the receiver device 3*a* and the receiver device 3*b* may output the sound signal to the speaker 4*a*.

The Second Embodiment

Figure 7:
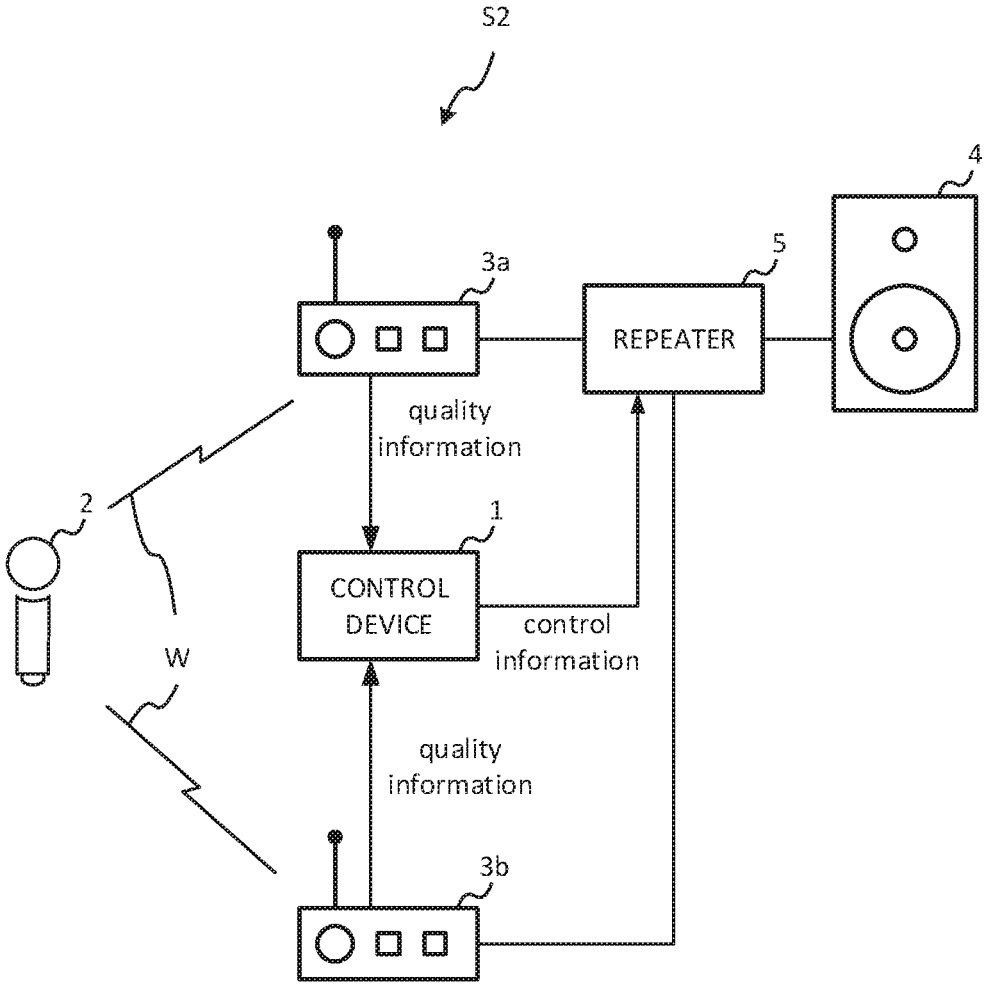
FIG. 7 shows a configuration of a microphone system according to the second embodiment.

FIG. 7 shows a configuration of a microphone system S2 according to the second embodiment. The microphone system S2 differs from the microphone system S1 according to the first embodiment in that it further includes a repeater 5.

The repeater 5 is connected to each of the plurality of receiver devices 3 and acquires the sound signals from the plurality of receiver devices 3. The repeater 5 is, for example, a mixer that outputs the sound signal, outputted by at least one of the plurality of receiver devices 3, to the speaker 4.

In the control device 1, the determination part 123 determines the receiver device 3 that outputs the sound signal to the speaker 4 out of the plurality of receiver devices 3 on the basis of the quality information acquired by the information acquisition part 121 from each of the plurality of receiver devices 3. The transmission control part 124 transmits, to the repeater 5, information for specifying the receiver device 3 determined by the determination part 123. For example, the transmission control part 124 transmits, to the repeater 5, identification information for identifying the receiver device 3 determined by the determination par 123. The repeater 5 specifies, on the basis of the information received from control device 1, the receiver device 3 that causes the speaker 4 to output the sound, and outputs the sound signal received from the specified receiver device 3 to the speaker 4.

The repeater 5 may have the function of the control device 1. In this case, the repeater 5 acquires the quality information from the plurality of receiver devices 3 and switches the receiver device 3 from which the sound signal to be outputted to the speaker 4 is received, on the basis of the acquired quality information.

The repeater 5 may be connected to the speaker 4*a* and the speaker 4*b* corresponding to the receiver device 3*a* and the receiver device 3*b*. In this case, the repeater 5 outputs the sound signal received from the receiver device 3*a* to the speaker 4*a* and outputs the sound signal received from the receiver device 3*b* to the speaker 4*b*.

[Effects of the Control Device 1 According to the Second Embodiment]

As described above, the control device 1 according to the second embodiment acquires the quality information from each of the plurality of receiver devices 3. Then, the control device 1 transmits the information for specifying the non-output receiver device determined on the basis of the acquired quality information to the repeater 5. Due to the control device 1 operating in this manner, the microphone system S2 can switch the receiver device 3 that outputs the sound signal without switching the frequency used for the wireless communication between the wireless microphone 2 and the receiver device 3.

The Third Embodiment

Figure 8:
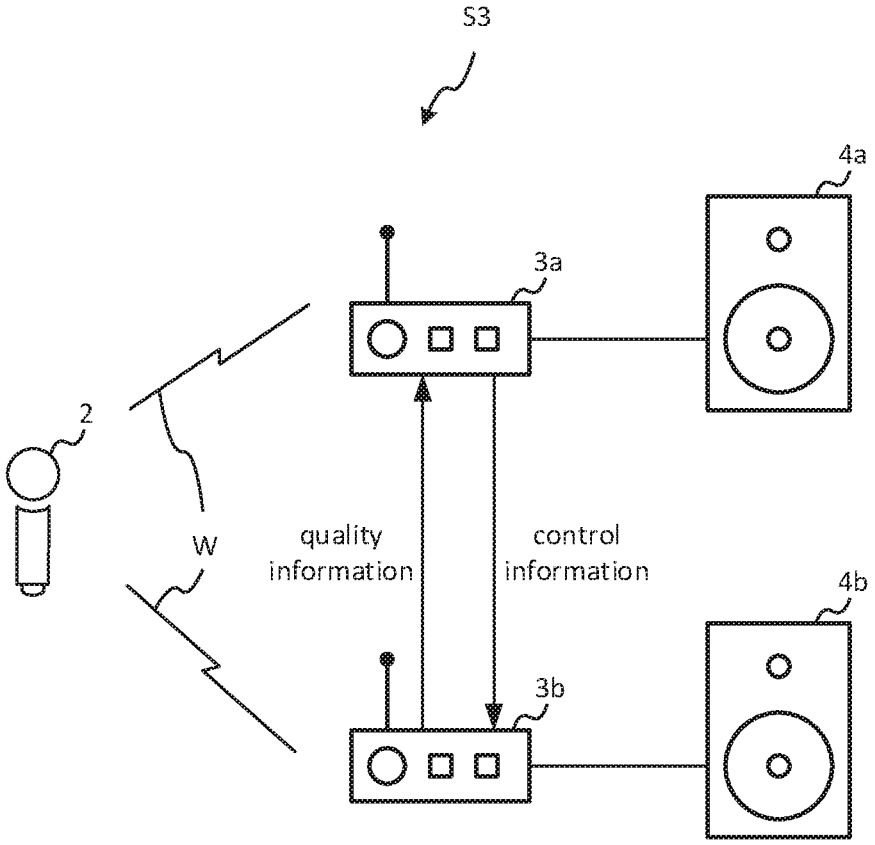
FIG. 8 shows a configuration of a microphone system according to the third embodiment.

FIG. 8 shows a configuration of a microphone system S3 according to the third embodiment. In the microphone system S3, the receiver device 3*a* has the function of the control device 1 in the microphone system S1 according to the first embodiment.

The receiver device 3*a* acquires the quality information from the receiver device 3*b*. The receiver device 3*a* selects the receiver device 3 that outputs the sound signal on the basis of the quality information indicating the quality of the sound signal received from the wireless microphone 2 and the quality information acquired from the receiver device 3*b*. That is, the receiver device 3*a* determines which of the receiver device 3*a* or the receiver device 3*b* will output the sound signal. If the determination part 123 determines that the receiver device 3*a* will output the sound signal, the transmission control part 124 of the receiver device 3*a* transmits the control information to the receiver device 3*b* for setting the receiver device 3*b* to the mute mode. If the determination part 123 determines that the receiver device 3*b* will output the sound signal, the receiver device 3*a* sets the receiver device 3*a* to the mute mode and transmits the control information to the receiver device 3*b* for setting the receiver device 3*b* to the output mode.

Due to one of the plurality of receiver devices 3 functioning as the control device 1 in this way, the microphone system S3 realizes the same effects as in the first embodiment without a separate control device 1.

The present invention is explained on the basis of the exemplary embodiments. The technical scope of the present invention is not limited to the scope explained in the above embodiments and it is possible to make various changes and modifications within the scope of the invention. For example, all or part of the apparatus can be configured to be functionally or physically distributed and integrated in arbitrary units. Further, new exemplary embodiments generated by arbitrary combinations of them are included in the exemplary embodiments of the present invention. The effect of the new embodiment caused by the combination has the effect of the original embodiment together.

Although a case where the input receiving part 122 receives the input of the criteria is exemplified above, the control device 1 does not have to include the input receiving part 122, and the criteria may be stored in the storage part 1 in advance. Further, a case where the microphone system includes two receiver devices 3 is exemplified in the above description, but the number of the receiver devices 3 is arbitrary. If there are three or more receiver devices 3, the control device 1 causes one receiver device 3 to output the sound signal and sets the other receiver devices 3 to the mute mode.

Further, the above description exemplifies a case where the receiver device 3 starts the operation in the output mode immediately after the power is turned on, but the receiver device 3 may operate in the mute mode immediately after the power is turned on. In this instance, the control device 1 transmits the output command to the receiver device 3 determined to cause the speaker 4 to output the sound, and the receiver device 3 which receives the output command starts to output the sound signal.

What is claimed is:

1. A control device for controlling a plurality of receiver devices that are located at different places, wherein each respective receiver device (i) receives a sound signal transmitted from a wireless microphone by radio, (ii) is connected to a respective speaker from among a plurality of speakers, and (iii) is capable of causing the respective speaker to output sound based on the sound signal, the control device comprising:

an information acquisition part that acquires quality information indicating a quality of the sound signal received by the plurality of receiver devices; and a determination part that determines from among the plurality of output receiver devices, on a basis of the quality of the sound signal indicated by the quality information, an output receiver device that causes the respective speaker to output the sound based on the signal and a non-output receiver device that does not cause the respective speaker to output the sound based on the sound signal, wherein the determination part switches a status such that a first receiver device of the plurality of receiver devices causes the respective speaker to output the sound and a second receiver device of the plurality of receiver devices does not cause the respective speaker to output the sound on a condition where (i) a first quality of the sound signal received by the first receiver device is better than a second quality of the sound signal received by the second receiver device and (ii) a difference between the first quality and the second quality is larger than a difference threshold, the first receiver device being the non-output receiver device not outputting the sound based on the sound signal, and the second receiver device being the output receiver device outputting the sound based on the sound signal.

2. The control device according to claim 1, further comprising:

a transmission control part that transmits, to the non-output receiver device, control information for setting the non-output receiver device to a mute mode that does not cause a speaker connected to the non-output receiver device to output a sound based on the sound signal.

3. The control device according to claim 1, further comprising:

a transmission control part that transmits, to the output receiver device, control information for setting the output receiver device to an output mode that causes the respective speaker to output a sound based on the sound signal.

4. The control device according to claim 1, further comprising:

a transmission control part that transmits, to a repeater that outputs the sound signal outputted by at least any one of the plurality of receiver devices to a respective speaker, information for specifying a receiver device that causes a speaker to output a sound, out of the plurality of receiver devices.

5. The control device according to claim 1, further comprising:

an input receiving part that receives an input of one or more criteria for the determination part to determine the non-output receiver device on the basis of the quality, wherein the determination part determines the non-output receiver device by comparing the quality to the one or more criteria.

6. The control device according to claim 1, wherein the determination part switches the status such that the first receiver device causes the respective speaker to output the sound and the second receiver device does not cause the respective speaker to output the sound, if a time corresponding to a duration threshold passes after a time when the first quality becomes better than the second quality and the difference between the first quality and the second quality becomes larger than the difference threshold.

7. The control device according to claim 1, further comprising:

an input receiving part that receives an input of a usage mode of the wireless microphone, wherein the determination part determines the non-output receiver device by comparing the quality to one or more criteria determined on a basis of the usage mode.

8. The control device according to claim 7, wherein the determination part uses a first criterion of the one or more criteria for not frequently causing the switching of the receiver device that outputs the sound signal in a first usage mode, and uses a second criterion of the one or more criteria, with which the receiver device that outputs the sound signal is easier to be switched than with the first criterion, in a second usage mode that differs from the first usage mode.

9. The control device according to claim 8, wherein the determination part, in the first usage mode, makes a first difference threshold larger than a second difference threshold in the second usage mode, the first difference threshold being a difference between the qualities of the sound signals respectively received by the two receiver devices, required to switch the receiver device that outputs the sound signal.

10. The control device according to claim 9, wherein the determination part, in the first usage mode, makes a first duration threshold longer than a second duration threshold in the second usage mode, the first duration threshold being a duration of a state where a difference, required to switch the receiver device that outputs the sound signal, between the qualities of the sound signals respectively received by the two receiver devices is larger than the first difference threshold and the second duration threshold being a duration of a state where a difference, required to switch the receiver device that outputs the sound signal, between the qualities of the sound signals respectively received by the two receiver devices is larger than the second difference threshold.

11. The control device according to claim 1, wherein the determination part switches the status such that the first receiver device causes the respective speaker to output the sound and the second receiver device does not cause the respective speaker to output the sound on a condition where the first quality is equal to or higher than the quality threshold.

12. A control device for controlling a plurality of receiver devices that are located at different places, wherein each respective receiver device (i) receives a sound signal transmitted from a wireless microphone by radio, (ii) is connected to a respective speaker from among a plurality of speakers, and (iii) is capable of causing the respective speaker to output sound based on the sound signal, the control device comprising:

an information acquisition part that acquires quality information indicating a quality of the sound signal received by the plurality of receiver devices; and a determination part that determines from among the plurality of output receiver devices, on a basis of the quality of the sound signal indicated by the quality information, an output receiver device that causes the respective speaker to output the sound based on the signal and a non-output receiver device that does not cause the respective speaker to output the sound based on the sound signal, wherein the information acquisition part further acquires permission/rejection information set in the wireless microphone, the permission/rejection information indicating whether to permit a switching of the non-output receiver device, and the determination part determines the non-output receiver device on a basis of the quality of the sound signal if the permission/rejection information indicates permission to switch the non-output receiver device, and does not determine the non-output receiver device on the basis of the quality of the sound signal if the permission/rejection information does not indicate permission to switch the non-output receiver device.

13. A microphone system comprising:

a wireless microphone;

a plurality of receiver devices that are located at different places, wherein each respective receiver device (i) receives a sound signal transmitted by the wireless microphone by radio, (ii) is connected to a respective speaker from among a plurality of speakers, and (iii) is capable of causing the respective speaker to output sound based on the sound signal; and a control device that controls the plurality of receiver devices, wherein the control device includes:

an information acquisition part that acquires quality information indicating a quality of the sound signal received by the plurality of receiver devices, and a determination part that determines from among the plurality of output receiver devices, on a basis of the quality of the sound signal indicated by the quality information, an output receiver device that causes the respective speaker to output the sound based on the signal and a non-output receiver device that does not cause the respective speaker to output the sound based on the sound signal.

14. A control device for controlling a plurality of receiver devices that are located at different places, wherein each respective receiver device (i) receives a sound signal transmitted from a wireless microphone by radio, (ii) is connected to a respective speaker from among a plurality of speakers, and (iii) is capable of causing the respective speaker to output sound based on the sound signal, the control device comprising:

an information acquisition part that acquires quality information indicating a quality of the sound signal received by the plurality of receiver devices; and a determination part that determines from among the plurality of output receiver devices, on a basis of the quality of the sound signal indicated by the quality information, an output receiver device that causes the respective speaker to output the sound based on the signal and a non-output receiver device that does not cause the respective speaker to output the sound based on the sound signal, wherein the determination part determines a receiver device of the plurality of receiver devices having the quality information indicating a highest sound signal quality as the output receiver device and all other receiver devices of the plurality of receiver devices as the non-output receiver devices.

15. A control device for controlling a plurality of receiver devices that each receive a sound signal transmitted from a wireless microphone by radio, the control device comprising:

an information acquisition part that acquires quality information indicating a quality of the sound signal received by the plurality of receiver devices; and a determination part that determines from among the plurality of output receiver devices, on a basis of the quality of the sound signal indicated by the quality information, a non-output receiver device that does not cause a speaker to output the sound based on the sound signal, wherein the determination part switches a status such that a first receiver device of the plurality of receiver devices causes a speaker to output the sound and a second receiver device of the plurality of receiver devices does not cause a speaker to output the sound on a condition where (i) a first quality of the sound signal received by the first receiver device is better than a second quality of the sound signal received by the second receiver device and (ii) a difference between the first quality and the second quality is larger than a difference threshold, the first receiver device being the non-output receiver device not outputting the sound based on the sound signal, and the second receiver device being the output receiver device outputting the sound based on the sound signal.

16. A control device for controlling a plurality of receiver devices that each receive a sound signal transmitted from a wireless microphone by radio, the control device comprising:

an information acquisition part that acquires quality information indicating a quality of the sound signal received by the plurality of receiver devices;

a determination part that determines from among the plurality of output receiver devices, on a basis of the quality of the sound signal indicated by the quality information, a non-output receiver device that does not cause a speaker to output the sound based on the sound signal; and an input receiving part that receives an input of a usage mode of the wireless microphone, wherein the determination part determines the non-output receiver device by comparing the quality to a first criterion for not frequently causing the switching of the receiver device that outputs the sound signal in a first usage mode, and determines the non-output receiver device by comparing the quality to a second criterion, with which the receiver device that outputs the sound signal is easier to be switched than with the first criteria, in a second usage mode that differs from the first usage mode.

* * * * *